United States Patent [19]

Pannetier

[11] 4,127,116

[45] Nov. 28, 1978

[54] MASSAGING APPARATUS

[76] Inventor: Henri Pannetier, 11, rue Philippe-le-Bel, 95 580 Andilly, France

[21] Appl. No.: 784,670

[22] Filed: Apr. 5, 1977

[30] Foreign Application Priority Data

Apr. 9, 1976 [FR] France ..... 76 10389

[51] Int. Cl.[2] ..... A61H 15/00

[52] U.S. Cl. ..... 128/57

[58] Field of Search ..... 128/57-59, 128/24.3, 56

[56] References Cited

U.S. PATENT DOCUMENTS

| | | | |
|---|---|---|---|
| 1,710,051 | 4/1929 | Giacopazzi | 128/24.3 |
| 2,003,272 | 5/1935 | Betz | 128/59 |
| 2,306,424 | 12/1942 | Betz | 128/59 |
| 3,297,024 | 1/1967 | Robinson | 128/59 X |

*Primary Examiner*—Lawrence W. Trapp
*Attorney, Agent, or Firm*—Omri M. Behr

[57] ABSTRACT

A massaging apparatus having two drums set angularly to each other and rotating in opposite directions under the action of motor means so that the tangential speeds on the side of the apparatus engaging the tissues are directed towards each other, these drums supporting, between their two flanges, a plurality of evenly distributed fixed or rotatable shafts, each fixed or rotatable shaft supporting, with regular axial spacing, a succession of pads respectively free or fixed to the shaft in question. These pads are axially staggered still in the same direction from one shaft to another adjacent shaft in the direction of rotation of the drum in question, and this for both drums, the angular setting of said drums being such that the pads of both drums which file past facing each other are themselves staggered.

13 Claims, 3 Drawing Figures

MASSAGING APPARATUS

The present invention relates to the field of messaging apparatus.

It concerns improvements made to massaging apparatus having two drums set angularly to each other and rotating in opposite directions under the action of a motor means so that the tangential speeds on the side of the apparatus engaging the tissues are directed towards each other, these drums each supporting between their two flanges, a plurality of evenly distributed fixed or rotary shafts, each fixed or rotary shaft supporting, with regular axial spacing, a succession of pads respectively free or fixed on the shaft in question.

U.S. Pat. No. 2,003,272 to W. G. BETZ already teaches an apparatus of the above-mentioned type in which each shaft is provided with a plurality of swellings with substantially cylindrical external surfaces evenly spaced apart on each shaft.

However in this known apparatus the swellings of the different shafts are located facing each other, including the swellings, belonging respectively to the two drums, which file past facing each other.

In operation, the tissues raised up between the two drums are nipped between the swellings exactly facing each other. This repeated nipping, besides being unpleasant for the patient, may also be harmful when massaging tender or painful parts.

Furthermore, because of the symmetrical arrangement of the swellings, the tissues are raised up simultaneously over the whole length of the apparatus; it results in a jerky massaging of the tissues and does not cause the driving back of the blood flow which would be desirable during massaging.

A fondamental object of the invention is the elemination of the disadvantages of this known apparatus by providing a massaging apparatus capable of effecting deep massage without nipping the tissues raised up between the two rotary drums, and which is also designed so that the tissues are not raised up simultaneously over the whole length of the apparatus and so that they undergo a treatment which works them alternately from one side to the other, whereby it is possible to effect the driving backof the blood flow, whose beneficial action is added to the massaging.

To do this, the apparatus of the invention is characterised in that, from one shaft to the next adjacent shaft in the direction of rotation of the drum under consideration, said pads are axially staggered always in the same directions for both drums, the angular setting of said two drums being such that the pads of the two drums which file past facing each other are themselves staggered.

This staggered arrangement of the pads avoids the above-mentioned nipping of the tissues and permits a progessive raising of the tissues along the length of the apparatus.

Advantageously, the gaps between the pads on each shaft are equal for all the shafts and the value of each gap is equal to $n$ times the staggering of the pads from one shaft to another, $n$ being a whole number.

The result is that the pads of each drum, as a whole, are arranged in a helix; in addition, on one of the drums, the helix has a right-hand thread whereas, on the other drum, the helix has a left-hand thread, which in operation provides the desired effect of driving back the blood flow.

The apparatus can furthermore be arranged, particularly as far as the number of shafts on each drum and the diameter of the pads mounted on each shaft are concerned, so that the pads of one shaft partially overlap the staggered pads of the two immediately adjacent shafts, the pads mounted on two adjacent shafts, belonging respectively to the two drums, also partially overlapping.

Thus, during rotational movement of the drums, the pads of two successive shafts engage the tissues substantially continuously, thus avoiding jarring which could be painful in the long run. Moreover the tissues are worked alternately left and right, this action being beneficially added to the deep massaging.

The invention will be better understood from the following description of one embodiment, given solely as an example which is in no way limitative. In this description reference is made to the accompanying drawings in which.

Figure 1:
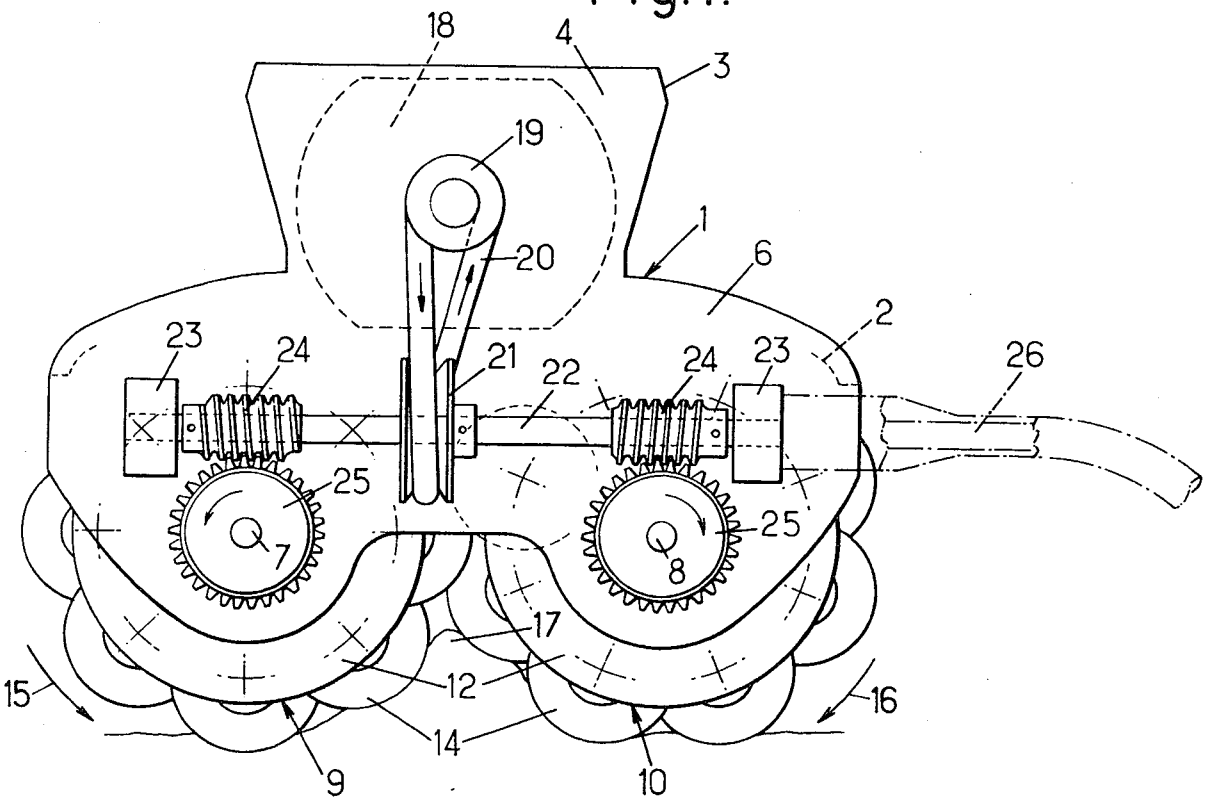
FIG. 1 is a side view of the apparatus of the invention with the side cover removed.
Figure 2:
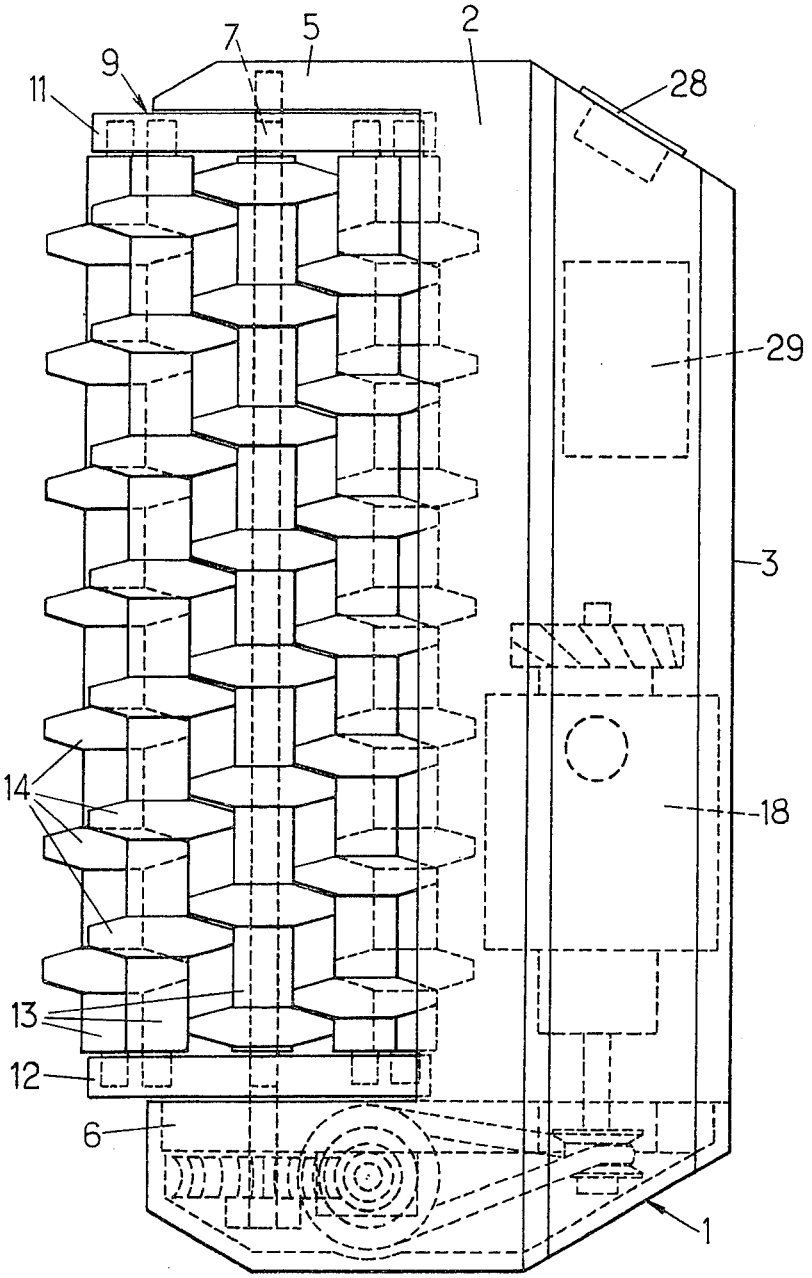
FIG. 2 is a front view of the apparatus of FIG. 1.
Figure 3:
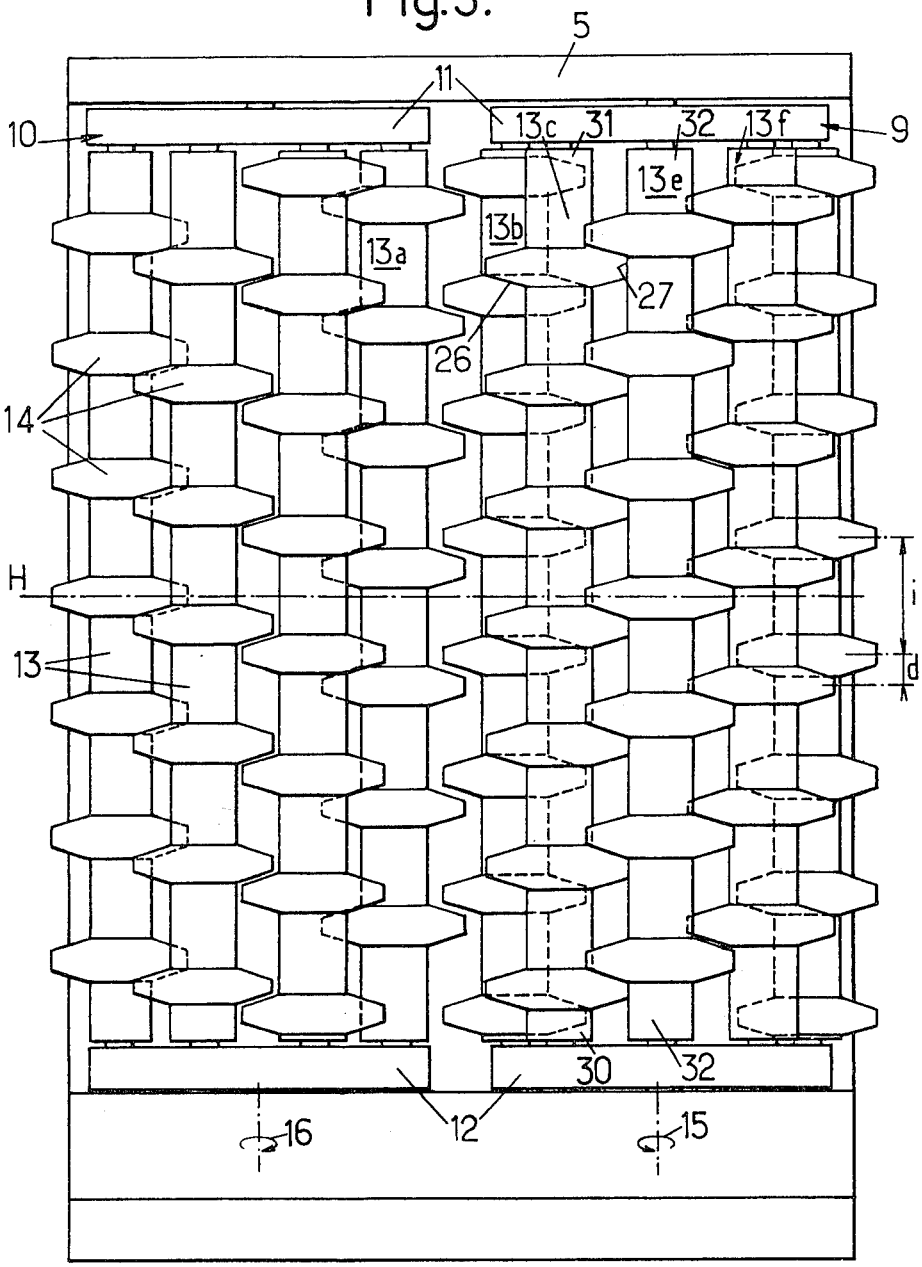
FIG. 3 is a bottom view of the apparatus of FIGS. 1 and 2.

The massaging apparatus shown in FIGS. 1 to 3 comprises a causing 1 formed by a cover 2 having, in its upper part, a projection 3 defining an inner space 4 usable as a handle for holding the apparatus. Moreover, at both its ends casing 1 has two side cheeks 5 and 6 (FIG. 2).

In the two cheeks of the casing are rotatably mounted two shafts 7, 8 parallel to each other, supporting respectively two drums 9, 10. Each drum comprises two flanges 11, 12 between which are disposed a plurality of shafts 13 evenly spaced circumferentially on the flanges. Each shaft 13 is provided with a number of coaxial pads 14 disposed perpendicularly to the shaft.

In the figures the pads 14 are shown as turning with the shaft which supports them, each shaft being rotatably mounted in the flanges of the drum. Thus it is possible to produce each shaft and the pads supported thereby as a single unit which can be moulded from plastic material so as to reduce the manufacturing cost thereof.

In another embodiment shafts 13 could be mounted, not rotatably, but fixed in flanges 11, 12 of the drums, pads 14 then being mounted loose on their bearing shafts. However, this construction is more complex and so more costly than that illustrated in the figures.

Driven by the motor means, the two drums rotate in synchronism and in opposite directions shown by the arrows 15 for drum 9 and 16 for drum 10, so that the tissues to be massaged are raised up between the two drums as shown at 17 in FIG. 1.

To this end, the motor means comprise an electric motor 18, housed in the inner space 4 of handle 3 and having, end mounted, a grooved pulley 19. This latter drives a belt 20 which passes round a second grooved pulley 21 rotating with a shaft 22 rotatably mounted in two bearings 23 fixed to the flange 6.

Shaft 22 comprises two worms 24 having the same pitch but being oppositely threaded, engaging respectively with two gears 25 rigidly locked respectively with shafts 7, 8 of the two drums.

If it is desired to reduce the dimensions of the apparatus and/or diminish the weight thereof, it is also possible to dispose the electric motor outside of the apparatus, the rotational movement then being transmitted to shaft 22 through a flexible transmission 26 (shown in dot-dash lines in FIG. 1) located between the shaft of the electric motor and one end of shaft 22.

As can best be seen in FIG. 3; from one shaft to another adjacent shaft following the direction of rotation of the drum under consideration, the pads are axially staggered still in the same direction and this for both drums. This staggering has been designated *d*. Furthermore the two drums are set relative to one another in such a way that the pads of the two drums mounted on shafts 13*a* and 13*b* which file past facing each other, are themselves staggered by an amount *d*.

To obtain an even distribution of the pads on a drum, the value of each gap is selected to be equal to *n* times (*n* being a whole number) the amount of stagger *d* of the pads from one shaft to another.

When the number of shafts is not too high (about three or four, for example), *n* can be selected equal to this number of shafts.

The result is that, on each drum, the pads, considered as a whole, are disposed in a helix, the winding pitch of these helices being the reverse of each other on the two drums.

However, when the number of shafts is higher than a few units, the gap between the pads would become too great to permit even massaging over the whole length of the apparatus. It is then preferable that *n* is a fraction of the number of shafts.

The pads are then disposed in several overlapping helices.

As an example, in FIGS. 1 to 3, each drum mounts eight shafts. So that the distance *i* between pads on the same shaft is not too great, the amount of stagger *d* is selected equal to *i*/4 and the pads on the same drum are disposed in two overlapping helices.

Moreover, it will be noted that, when the drums are provided with only a small number of pad-bearing shafts (e.g. 3 or 4), at each fraction of a rotation of the drums, the coming into contact of the pads of a shaft with the tissues to be massaged are accompanied by an impact effect.

This effect may be beneficial for some treatments (slimming, relaxation) for it permits the sub-cutaneous fatty tissues to be divided up.

However, this impact effect may be harmful in some therapeutics, for example the massaging of painful or tender parts. So that the rolling of the drums on the tissues being massaged takes place without undue impacts, a fairly large number of shafts is provided in each drum, this number being for example equal to eight as shown in the figures.

In order to improve even more the effect obtained and to avoid nipping the tissues raised up between the facing pads of both drums, overlapping of the pads is provided which is made possible owing to the staggering of the pads on successive shafts.

With this in view, the shafts are distributed around the periphery of each drum and the diameter of the pads is chosen so that the pads on one shaft partially overlap (at 26) the staggered pads of both immediately adjacent shafts, the pads mounted on two facing shafts 13*a* and 13*b*, belonging respectively to both drums, also partially overlapping.

To avoid any nipping of the tissues between two adjacents staggered pads, the staggering of the pads is such that there exists a small clearance between the facing parts 26 (FIG. 3) of the side faces of two pads belonging respectively to two adjacent shafts, and the partial overlapping of the pads is arranged such that there exists a small clearance between the peripheral surface 27 of a pad and the external surface of the adjacent shaft.

Moreover, so as to make the massaging more punctual, the surface of each pad contacting the tissues being massaged is advantageously reduced; to do this each pad is tapered towards its edge and has preferably a biconical shape.

Of course, it is possible to provide the above-described apparatus with different complementary means for making it easier to use and for increasing its efficiency.

For example, a switch 28 (see FIG. 2) is provided with a starting indicator light and a speed variator 29 (e.g. electric) controlling the operation of electric motor 18, so as to be able to adapt the rotational speed of the drums to the desired treatment of the tissues.

Although the different arrangements described give the apparatus interesting characteristics, the design of the apparatus remains simple.

In particular, it will be noted that the pad-bearing shafts used in the apparatus shown in FIGS. 1 to 3 belong to only three distinct types; as can best be seen in FIG. 3, these three types are the following:

(a) shaft 13*b* on which the pads are distributed over the whole length; this shaft mounts (in this particular embodiment) eight pads symmetrically distributed on both sides of median plane H situated transversely of the shaft, on the basis of four pads on each side of this plane;

(b) shaft 13*c* on which the pads are staggered by an amount *d* relative to the pads of shaft 13*b*; because of this the free ends 30 and 31 of this shaft are of unequal lengths and the distribution of the pads, of which there are only seven, is not symmetrical relative to plane H;

(c) Shaft 13*e*, finally on which the pads are stagged by an amount *d* relative to the pads of shaft 13*c*, and so by an amount 2*d* relative to the pads of shaft 13*b*; there are seven of these pads and they are symmetrically distributed, one in plane H and three on each side of this plane; the lengths of the free ends 32 of the shaft are identical.

Each drum is formed by a combination of these three types of shaft, alternately disposed, the shafts of type 13*c*, asymmetrical, being located in one or other of the possible positions, i.e. the longest end 31 on the flange 11 side (this is the case for shaft 13*c* or on flange 12 side (this is the case for shafts 13*a* and 13*f*).

As is evident, and as this follows moreover from what has gone before, the invention is in no wise limited to those modes of application and embodiments more particularly considered; it covers on the contrary all variations.

I claim:

1. A massaging apparatus comprising:

A. a means for driving said apparatus; and

B. two adjacent drums adapted to be driven by said driving means, said drums being offset from each other and adapted to rotate in opposite directions so that the tangential speeds of the adjacent drums are directed towards each other on the tissue engaging side thereof, each drum including:

(i) two flanges spaced apart from each other;

(ii) a plurality of shafts disposed between said two flanges and spaced at equal intervals about the circumference thereof; and (iii) a plurality of equally spaced pads supported by said shafts, said pads being axially staggered from one shaft to another adjacent shaft, the angular positioning of the two drums being such that the pads of both the drums which file past facing each other are themselves staggered.

2. The apparatus of claim 1 wherein gaps separating the pads on each shaft are equal for all shafts and wherein the magnitude of the gap is equal to *n* times the stagger of the pads from one shaft to the other, *n* being a whole number.

3. The apparatus of claim 1 wherein the pads of one shaft partially overlap the staggered pads of two immediately adjacent shafts, and, the pads mounted on two adjacent shafts, belonging respectively to the two drums, also partially overlap.

4. The apparatus of claim 1 wherein the staggering of the pads is such that there exists a small clearance between the facing parts of the side faces of the two pads belonging respectively to two adjacent shafts; and, wherein the overlapping of the pads is such that there exists a small clearance between the peripheral surface of one pad and the external surface of the adjacent shaft.

5. The apparatus of claim 1 wherein each shaft and the pads thereon form a single unit.

6. The apparatus according to claim 5 wherein each unit consisting of a shaft and its associated pads are formed from a molded plastic material.

7. The apparatus of claim 1 wherein said means for driving is part of a rotational drive means that further includes:

a shaft driven by said driving means;

a pair of worm gears having respectively reversed pitches mounted on said shaft; and, a pair of gear wheels each respectively connected to one of said two drums and driven respectively by one of said worm gears.

8. The apparatus of claim 7 wherein the means for driving comprises an electric motor.

9. The apparatus of claim 7 wherein said means for driving comprises an electric motor disposed outside of said apparatus; and, a flexible transmission for connecting said motor driving means to the worm gear mounting shaft.

10. The apparatus of claim 1 wherein the staggering of the pads is such that a small clearance exists between the facing portions of the side faces of two pads of respectively two adjacent shafts, and the overlapping of the pads is such that a small clearance exists between the peripheral surface of one pad and the outer surface of the adjacent shaft.

11. A massaging apparatus comprising:

A. means for driving said apparatus; and

B. two adjacent drums adapted to be driven by said driving means, said drums being offset from each other and adapted to rotate in opposite directions so that the tangential speeds of the adjacent drums are directed towards each other on the tissue engaging side thereof, each drum including:

(i) two flanges spaced apart from each other, (ii) a plurality of shafts connected between two flanges and spaced at equal intervals about the circumference thereof, and (iii) a plurality of equally spaced pads supported by said shafts, said pads being axially staggered from one shaft to another adjacent shaft, the angular positioning of the two drums being such that the pads of both the drums which file past facing each other are themselves staggered, the staggering of the pads being such that a small clearance exists between the facing portions of the side faces of two pads of respectively two adjacent shafts, the overlapping of the pads being such that a small clearance exists between the peripheral surface of one pad and the outer surface of the adjacent shaft.

12. The apparatus of claim 11 wherein said plurality of shafts are journalled in said two flanges.

13. The apparatus of claim 11 wherein said pads are journalled on said shafts.

* * * * *